US007234525B2

(12) United States Patent
Alves et al.

(10) Patent No.: US 7,234,525 B2
(45) Date of Patent: Jun. 26, 2007

(54) AUTOMATED CHEMICAL STICK LOADER FOR GAS WELLS AND METHOD OF LOADING

(76) Inventors: Lee Alves, 1421 W. Alabama, Hobbs, NM (US) 88242; Kennith Shade, 4012 N. Callie Grandee, Hobbs, NM (US) 88240

( * ) Notice: Subject to any disclaimer, the term of this patent is extended or adjusted under 35 U.S.C. 154(b) by 183 days.

(21) Appl. No.: 11/211,649

(22) Filed: Aug. 26, 2005

(65) Prior Publication Data

US 2006/0054326 A1 Mar. 16, 2006

Related U.S. Application Data

(60) Provisional application No. 60/604,834, filed on Aug. 27, 2004.

(51) Int. Cl.
*E21B 43/00* (2006.01)

(52) U.S. Cl. ..... 166/310; 166/75.15; 166/53

(58) Field of Classification Search ..... 166/310, 166/75.15, 75.11, 53, 379; 414/745.1, 745.8, 414/745.9, 746.7, 746.8, 910; 198/463.1, 198/469.1, 486.1, 457.03, 456, 576, 578
See application file for complete search history.

(56) References Cited

U.S. PATENT DOCUMENTS

| | | | | |
|---|---|---|---|---|
| 3,403,729 | A | 10/1968 | Hickey | |
| 4,778,044 | A * | 10/1988 | Kondo | 198/464.2 |
| 4,785,880 | A | 11/1988 | Ashton | |
| 4,929,138 | A | 5/1990 | Breuning | |
| 5,016,708 | A * | 5/1991 | Baer et al. | 166/68.5 |
| 5,188,178 | A | 2/1993 | Noyes | |
| 5,709,266 | A * | 1/1998 | Kruse | 166/75.15 |
| 5,813,455 | A | 9/1998 | Pratt et al. | |
| 6,039,122 | A | 3/2000 | Gonzales | |
| 6,044,905 | A | 4/2000 | Harrison, III | |
| 6,056,058 | A | 5/2000 | Gonzalez | |
| 6,085,852 | A * | 7/2000 | Sparks et al. | 175/52 |
| 6,269,875 | B1 | 8/2001 | Harrison, III et al. | |
| 6,283,202 | B1 | 9/2001 | Gaines | |
| 6,478,089 | B2 | 11/2002 | Alves et al. | |
| 6,637,512 | B2 | 10/2003 | Casey | |
| 2002/0129941 | A1 | 9/2002 | Alves et al. | |
| 2003/0010504 | A1 | 1/2003 | Casey | |

FOREIGN PATENT DOCUMENTS

| | | |
|---|---|---|
| DE | 3528743 | 5/1990 |

* cited by examiner

*Primary Examiner*—Kenneth Thompson
(74) *Attorney, Agent, or Firm*—Richard C. Litman

(57) ABSTRACT

The automated chemical stick loader includes a ground-based stick storage and dispensing cabinet, an automated valve actuating system atop the wellhead, and a fixed stick transfer tube extending between the storage and dispensing cabinet and the top of the wellhead. A series of chemical sticks are stored in an endless conveyor in the cabinet, with the cabinet dispensing the sticks singly and sequentially to the bottom of the transfer tube upon actuation of the system. Sticks are pushed linearly up the transfer tube until reaching the top of the wellhead, whereupon the topmost stick falls into the well when the valves are actuated to allow passage of the stick therethrough.

19 Claims, 12 Drawing Sheets

AUTOMATED CHEMICAL STICK LOADER FOR GAS WELLS AND METHOD OF LOADING

CROSS-REFERENCE TO RELATED APPLICATION

This application claims the benefit of U.S. Provisional Patent Application Ser. No. 60/604,834, filed Aug. 27, 2004.

BACKGROUND OF THE INVENTION

1. Field of the Invention

The present invention relates generally to the natural gas and petroleum industry. More specifically, the present invention relates to a mechanism for automatically and safely dispensing chemical sticks (e.g., soap or detergent sticks, etc.) into a pressurized gas well, to provide certain advantages in gas production.

2. Description of the Related Art

Gas wells generally produce natural gas by means of subterranean pressures, which force the gas to the surface of the drilled well. However, the subterranean gas within a well is always adulterated with various other substances which often interfere with the flow of gas from the well. The most common of these foreign substances is water, which can accumulate in the well bore to such an extent that it produces an overpressure that prevents the gas from coming out of solution and percolating to the top of the well, a condition known as a "drowned well." Other conditions can occur with gas and oil wells which impede or preclude fluid flow, damage equipment and pipe within the well, and/or create other problems.

As a result, various treatments have been developed for correcting these problems from the surface. In the case of gas wells, the most common problem is water infiltration into the subterranean gas well bore, as noted above. A successful treatment of this problem has been developed, in which surfactants or "soap sticks" are dropped down the wellhead to dissolve within the well. The surfactant results in foaming of the water and gas mixture, breaking up the water so the gas may penetrate from below to escape from the well. This can increase gas production significantly from an otherwise unproductive "drowned" well. Other chemical sticks for treating other problems may also be introduced into the well from the wellhead, as required.

Conventionally, chemical sticks are generally manually dropped into the well through a series of sequentially actuated valves at the top of the wellhead, or by means of an automated machine located at the top of the well. In either case a worker must climb to the top of the wellhead, either to manually operate the valves to allow the insertion of a chemical stick into the wellhead, or at least to periodically reload an automated dispenser situated at the top of the wellhead. Climbing a ladder to the top of the wellhead perhaps ten or more feet above the surface with a relatively heavy load of chemical sticks, perhaps in a relatively high wind, snow, ice, or some other adverse condition, offers less than perfect safety, to say the least.

As a result, the present inventors developed an automated chemical stick dispenser which delivers sticks to the top of the wellhead from an automated dispenser on the surface, with the dispenser being easily reloaded as required from the surface. This has proven to be a major improvement in well maintenance safety, as the field worker need not climb to the top of the wellhead to service the stick dispenser during normal operation of the device. However, the machine previously developed by the present inventors operates in an entirely different manner from the present invention, utilizing a movable launch tube which is hinged to the top of the wellhead. Other differences are also present between the two machines, as described in detail further below.

The present invention overcomes the problems resulting from wellhead mounted stick dispensing devices by providing a ground-based dispenser which may be serviced by personnel from the ground during normal operations, rather than requiring them to climb a ladder in perhaps adverse conditions to service the dispenser. Moreover, the present machine has no externally disposed major moving components, as does the machine previously developed by the present inventors. Accordingly, the present chemical stick dispenser provides greater reliability and lower service requirements and costs of operation, as well as greater safety for field personnel, than machines of the prior art.

A discussion of the related art of which the present inventors are aware, and its differences and distinctions from the present invention, is provided below.

U.S. Pat. No. 3,403,729 issued on Oct. 1, 1968 to Charles J. Hickey, titled "Apparatus Useful For Treating Wells," describes a manually actuated mechanical device for injecting resilient sealing balls into a pipe in a well bore. The balls block certain perforations in the pipe, to prevent pressure loss therethrough during substrate fracturing operations. The Hickey apparatus is primarily directed to providing an accurate count of the balls dispensed. The Hickey apparatus does not provide for any form of automated and/or pneumatically powered operation, as it is intended to be operated only infrequently when subterranean fracturing of the substrate around a well is required. No means of automatically delivering elongate chemical sticks from a surface-dispensing machine to the top of the wellhead is provided by Hickey.

U.S. Pat. No. 4,785,880 issued on Nov. 22, 1988 to Robert Ashton, titled "Apparatus For Dispensing Chemicals Into Oil And Gas Wells," describes an automated stick dispenser having a cylindrical or carousel configuration, mounted atop the wellhead. The device is mechanically operated, rather than using pneumatic power from the pressure of the gas well, as in the present invention. Most importantly, the Ashton device can only be serviced by climbing to the top of the wellhead, whereas the present stick loader is serviced and replenished from the ground.

U.S. Pat. No. 4,929,138 issued on May 29, 1990 to Kurt Breuning, titled "Device For Feeding Rodlike Workpieces," describes a machine having a sloped feeding tray in which the rods are disposed in a side-by-side array and roll downwardly toward a handling mechanism comprising a pair of wheels which grip the rods in channels therebetween. The rods roll inwardly toward the handling mechanism, rather than being propelled from the handling mechanism to a conveyor or dispensing tube, as in the present invention. Moreover, the chemical sticks handled by the present invention are transferred linearly, end-to-end up the transfer tube after being dispensed from their side-by-side array in the conveyor within the dispensing portion of the present apparatus. In any event, the Breuning device is not related to any apparatus for handling chemical sticks for insertion into a wellhead.

U.S. Pat. No. 5,188,178 issued on Feb. 23, 1993 to Jonathan C. Noyes, titled "Method And Apparatus For Automatic Well Stimulation," describes another carousel-type stick feeder disposed at the top of the wellhead, similar to the device of the Ashton '880 U.S. patent discussed further above. The same points raised in the discussion of the Ashton device are seen to apply here as well.

U.S. Pat. No. 5,813,455 issued on Sep. 29, 1988 to Gary V. Pratt et al., titled "Chemical Dispensing System," describes an automated chemical stick dispenser comprising an elongate magazine in which the sticks are stacked vertically, end-to-end. The device is hinged to the top of the wellhead, and pivoted from its hinge attachment to lower its distal end to the surface for loading. The device is then pivoted back into place above the wellhead for operation. While the device can be loaded from the surface, it does not rest upon the surface to propel the chemical sticks upwardly through a transfer tube or the like, as in the case of the present invention.

U.S. Pat. No. 6,039,122 issued on Mar. 21, 2000 to Leonel Gonzalez, titled "Methods And Apparatus For Automatically Launching Sticks Of Various Materials Into Oil And Gas Wells," describes another carousel-type stick loading magazine atop a gas well. This device simplifies the system, by eliminating the valves between the well and the carousel magazine. The magazine is pressurized to prevent gas from escaping from the system. The well is closed off whenever the magazine must be opened for reloading. This system adds to the danger of servicing or reloading a wellhead top mounted system, not only due to the height, but also due to the pressurized gas contained within the magazine.

U.S. Pat. No. 6,044,905 issued on Apr. 4, 2000 to William G. Harrison III, titled "Chemical Stick Storage And Delivery System," describes yet another carousel type system placed atop the wellhead. The valves are hydraulically actuated rather than using the pneumatic principle by means of gas pressure from the well, as in the present invention.

U.S. Pat. No. 6,056,058 issued on May 2, 2000 to Leonel Gonzalez, titled "Methods And Apparatus For Automatically Launching Sticks Of Various Materials Into Oil And Gas Wells," is the parent of a divisional application from which the '122 U.S. patent to the same inventor issued, the '122 reference being discussed further above. The same points noted in that discussion are seen to apply here as well.

U.S. Pat. No. 6,269,875 issued on Aug. 7, 2001 to William G. Harrison III et al., titled "Chemical Stick Storage And Delivery System," is a continuation-in-part of the application resulting in the issued '905 U.S. patent described further above. The primary difference between the two devices is the use of a central processing unit to control the release of the chemical sticks in the system of the '875 patent, whereas the earlier issued '905 U.S. patent discloses only the use of a timer. Both provide a stick dispenser or magazine disposed atop the wellhead, unlike the present invention.

U.S. Pat. No. 6,283,202 issued on Sep. 4, 2001 to Gene Gaines, titled "Apparatus For Dispensing A Chemical Additive Into A Well," describes a dispenser mounted atop the wellhead, with the dispenser holding only a single chemical stick. While a timer and actuating mechanism are provided for automatically releasing the stick, no means is provided for sequentially dispensing a series of chemical sticks into the well over a period of time, as provided by the present invention.

U.S. Patent Publication No. 2002/129,941 published on Sep. 19, 2002 and applied for by Lee Alves et al., titled "Automatic Chemical Stick Loader For Wells And Method Of Loading," describes a system having a ground-based stick storage magazine and dispenser, with an elongate delivery tube movably extending between the storage magazine and the top of the wellhead. Rather than being fixed between the magazine and the top of the wellhead, as in the present invention, the system of the '941 U.S. Patent Publication automatically and selectively moves one end of the delivery tube between a lowered position communicating with the stick dispenser magazine, where it receives a single chemical stick, and a raised position with the magazine dispenser end of the tube raised generally vertically above the wellhead. The wellhead end of the tube remains pivotally attached to the wellhead at all times. In contrast, the stick delivery tube extending between the dispensing cabinet or magazine and the top of the wellhead in the present invention remains fixed in place at all times; there are no external moving parts or components in the present system. The '941 U.S. Patent Publication also discloses the use of solar power for the electrical energy required to operate the system, the use of pneumatic power from the pressure of the gas well to operate the pneumatic devices of the system, and the use of a programmable electronic controller for actuating the device according to time interval, weather, well conditions, etc., which features are all hereby incorporated by reference into the present application.

U.S. Pat. No. 6,478,089 issued on Nov. 12, 2002 to Lee Alves et al., titled "Automatic Chemical Stick Loader For Wells And Method Of Loading," is the issued U.S. patent based upon the '941 U.S. Patent Publication discussed immediately above. The same points noted in that discussion are seen to apply to the '089 U.S. patent to the same inventors, as well.

U.S. Patent Publication No. 2003/10,504 published on Jan. 16, 2003 and applied for by Dan Casey, titled "Soap Stick Launcher And Method For Launching Soap Sticks," describes a device having a stick dispensing canister or magazine disposed at the top of the wellhead, and pressurized by well gas. As such, the Casey device is more closely related to the device of the '122 and '058 U.S. patents to Gonzalez, discussed further above, than it is to the present invention.

U.S. Pat. No. 6,637,512 issued on Oct. 28, 2003 to Dan Casey, titled "Soap Stick Launcher And Method For Launching Soap Sticks," is the issued U.S. patent based upon the '502 U.S. Patent Publication discussed immediately above. The same points noted in the discussion of the '502 U.S. Patent Publication are seen to apply here as well.

Finally, German Patent No. 3,528,743 published on Feb. 12, 1987, titled "Device For Feeding Rodlike Workpieces," is the German Patent Publication upon which the '138 U.S. patent to the same inventor, discussed further above, is based. The same points noted in that discussion are seen to apply here as well.

None of the above inventions and patents, taken either singly or in combination, is seen to describe the instant invention as claimed. Thus an automated chemical stick loader for gas wells, and a method of automatically loading chemical sticks into a gas well, solving the aforementioned problems is desired.

SUMMARY OF THE INVENTION

The present automated chemical stick loader provides for the automated dispensing of chemical sticks, e.g., "soap sticks," etc., into the wellhead of a gas well for the treatment of certain conditions within the well. The present stick loader does not require maintenance workers to climb to the top of the wellhead several feet above the ground to replenish the supply of chemical sticks, for normal operations.

The present automated stick dispenser essentially comprises three basic components: (1) a ground-based stick storage and dispensing box or unit; (2) a wellhead valve sequencing system disposed at the top of the wellhead; and (3) a fixed stick transfer tube extending between a dispensing trough at the stick storage and dispensing box and the top of the wellhead. The dispensing of chemical sticks from the stick storage and dispensing box and the sequential actuation of valves at the top of the wellhead for dropping sticks into the well are controlled by a series of pneumatically-actuated valves using regulated well pressure. Actuation of the system may be controlled by a timer or by an electronic controller, which may be programmed to take into account various other factors, e.g., wellhead pressure, water vapor content of well gas, etc., as desired.

The present system is completely automated, and requires no intervention whatsoever by a field worker or other person for normal operation. The surface-based stick storage and dispensing unit may hold on the order of one hundred (or perhaps more, depending upon the size of the machine) chemical sticks therein on an endless conveyor. Normally, well treatment requires a stick to be dispensed perhaps only once every several hours for extreme well treatment, with a more normal treatment requiring a stick perhaps only once every one or two days or so. Accordingly, the present machine requires restocking on the order of perhaps once in a few weeks at the most frequent dispensing rate likely, to perhaps once in a few months at a more normal dispensing rate. When replenishing the stick supply is required, the process requires only a few minutes of time to open the ground-based storage unit, place a stick in each position of the conveyor, and close the box, all without being required to climb to the top of the wellhead.

These and other features of the present invention will become readily apparent upon consideration of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises an apparatus or mechanism for automatically dispensing chemical treatment sticks into the wellhead of a gas well, in order to improve gas flow from the well and/or provide other benefits. The most common problem requiring such treatment is the accumulation of water in the well at relatively high pressure, thereby preventing the gas from coming out of solution and escaping from the well. The standard treatment for such a "drowned well" condition is to insert sticks of surfactant (i.e., "soap sticks") into the well, to cause the water to foam and allow the gas to bubble through the water and escape from the well. The present machine provides an automatic means of periodically inserting such soap sticks (or other types of chemical sticks) into a gas well. Routine maintenance and replenishment of the chemical stick supply is accomplished at ground level without need to climb to the top of the wellhead at some distance above the surface.

Figure 1:
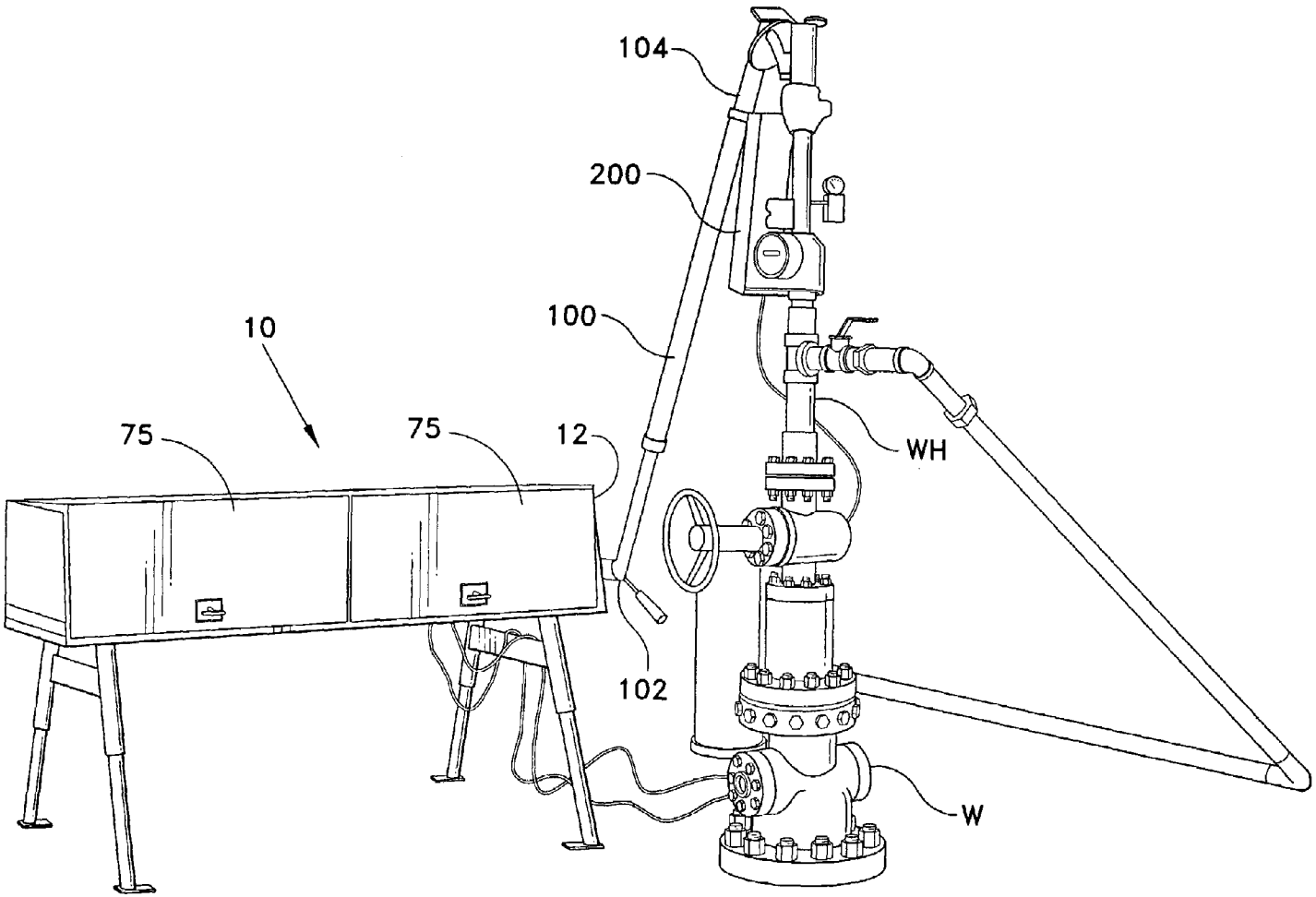
FIG. 1 is an environmental, perspective view of an automated chemical stick loader for gas wells according to the present invention, showing its installation at a gas well.

FIG. 1 provides an environmental perspective view of the present invention installed at a gas well W, with the gas well W having a relatively tall (e.g., ten feet above the surface, more or less) wellhead WH extending upwardly therefrom. The present invention essentially comprises three basic components, with each of those components having various operating and actuating mechanisms therein. One of the basic components is a ground-based, i.e., resting upon the surface, chemical stick storage and dispensing cabinet 10. The cabinet 10 may be placed atop a series of legs or supports. The cabinet 10 is accessible from the ground or surface level by a field worker standing on the surface.

The stick storage and dispensing cabinet 10 passes chemical sticks out to the second component, i.e., a chemical stick transfer tube 100. The transfer tube 100 includes a cabinet attachment end 102 permanently affixed to the stick dispensing end 12 of the cabinet 10, and extends to an opposite wellhead attachment end 104 which is permanently affixed to the third major component, i.e., a sequentially actuated chemical stick passage mechanism 200 situated at the top of the wellhead WH.

Figure 2:
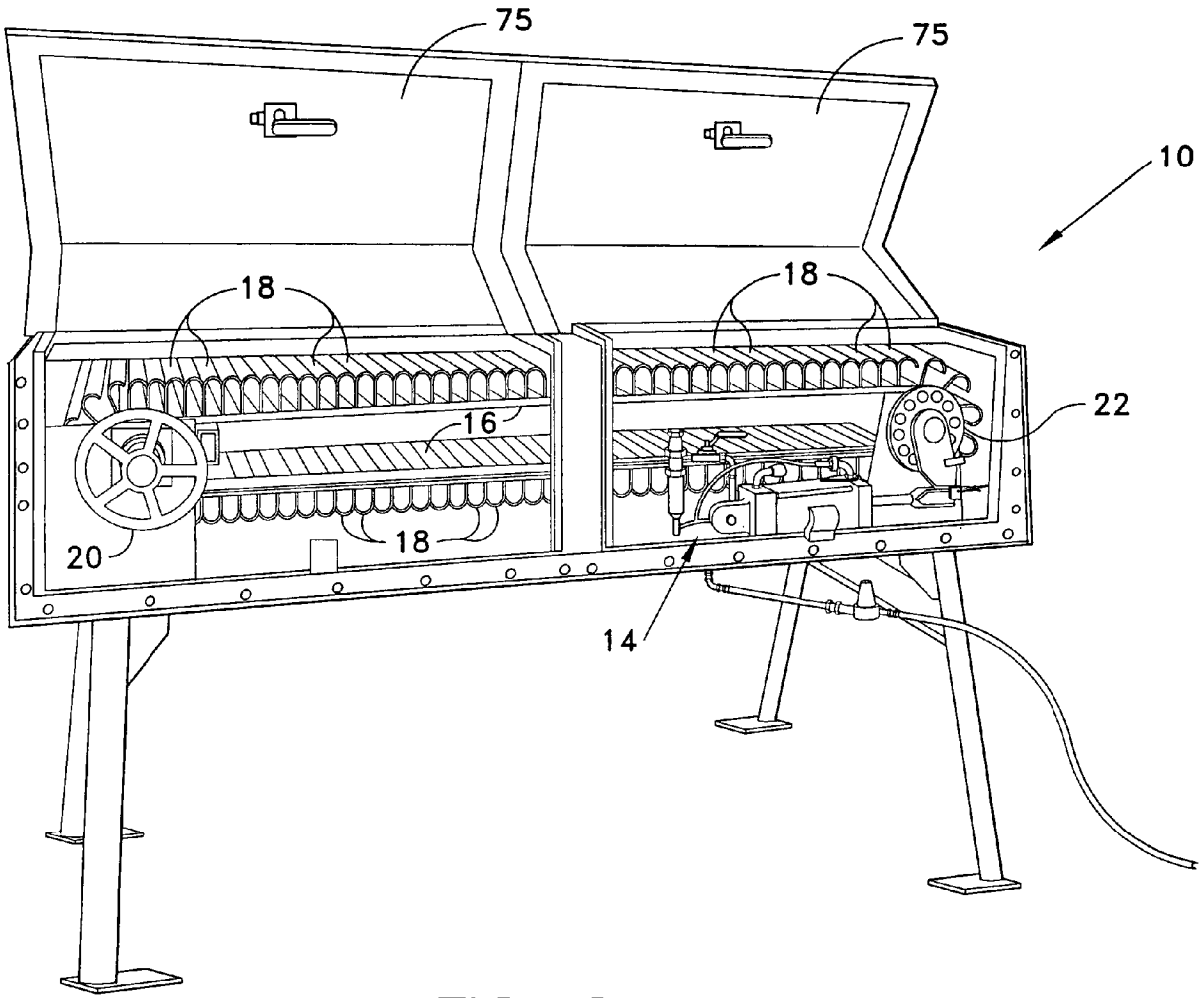
FIG. 2 is a perspective view of the ground-based chemical stick dispenser for the present invention, with access panels opened to show various details thereof.

FIG. 2 of the drawings provides a detailed internal view of the stick storage and dispensing cabinet 10. The cabinet 10 includes a sequentially actuated chemical stick dispensing mechanism 14 therein, with the sequence being actuated by a controller and governed by a series of sequentially operating pneumatic valves and cylinders thereafter. The stick dispensing mechanism 14 includes an endless loop conveyor belt 16 which serves to store and dispense chemical sticks contained thereon. The belt 16 includes a series (e.g., one hundred, more or less) of flights 18, each having a generally J-shaped cross section. The curved outer ends of the J-shapes abut one another along the straight portions of the conveyor belt 16 run to form an essentially closed outer surface, but separate as the flights 18 curve around the idler end 20 and drive end 22 of the conveyor belt loop. This configuration provides for the release of chemical sticks held along the conveyor belt 16 at a certain position or location along the belt run, as shown in FIG. 3 and discussed in detail below.

Figure 3:
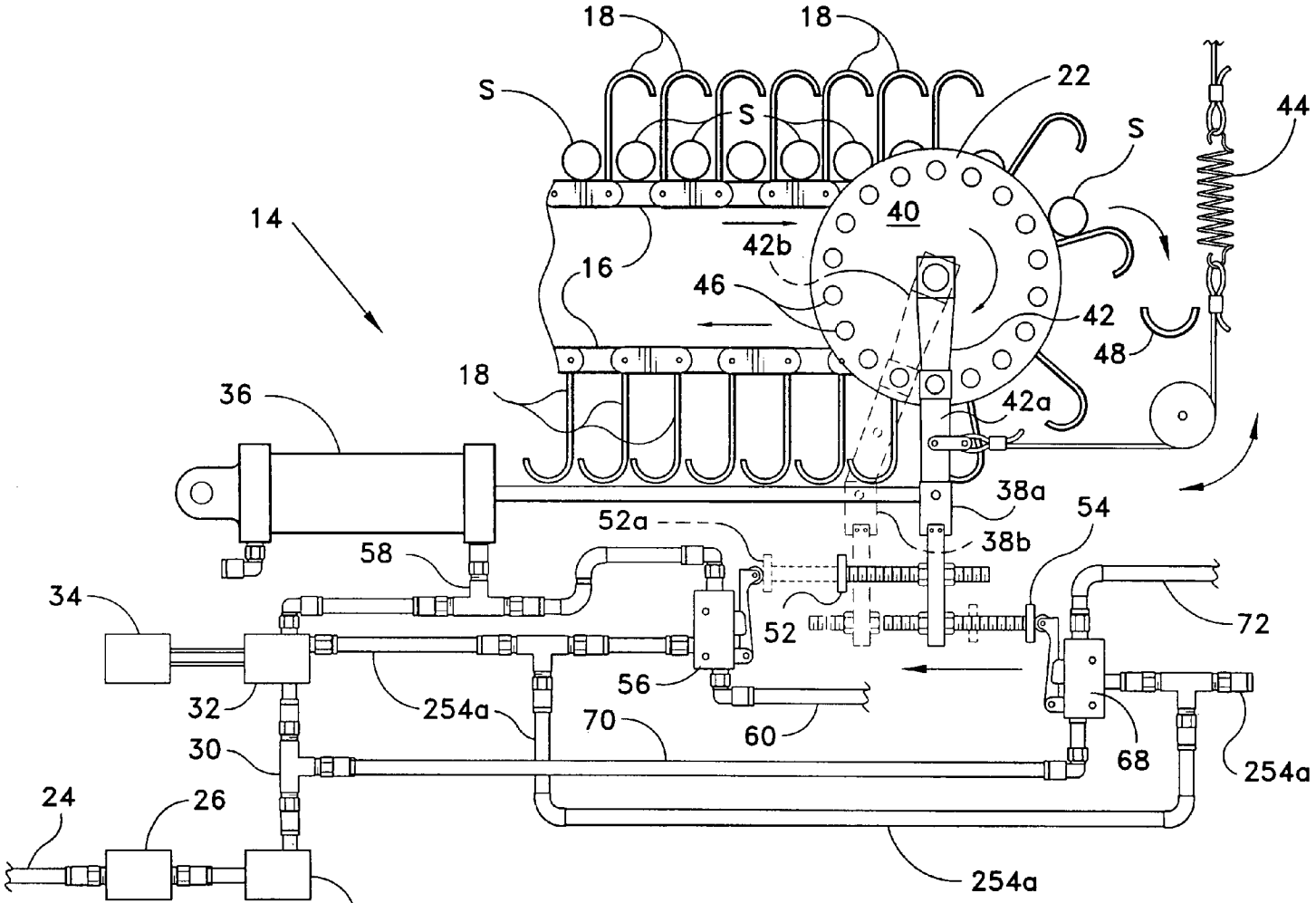
FIG. 3 is a detailed front elevation view of the stick dispensing end of the stick conveyor and pneumatic actuating system for the dispenser unit, showing its operation.

FIG. 3 illustrates the drive end 22 of the conveyor 16, as well as the actuating and stick dispensing systems of the stick storage and dispensing cabinet 10. The present automated chemical stick storage and dispensing system is preferably pneumatically operated, receiving pneumatic pressure from the wellhead WH of the gas well W through a supply line 24. A manually controllable shutoff valve 26 may be placed inline with the supply line 24. Pneumatic pressure is supplied to a regulator 28 inline with the actuating gas supply line 24 to regulate pneumatic pressure down to about twenty psi, more or less. The pressure may be adjusted or regulated as desired.

From the regulator 28, pneumatic pressure passes to a tee 30, where it is sent to a normally closed, solenoid-controlled pneumatic shutoff valve 32 and to a pneumatic switch, discussed further below. The shutoff valve 32 communicates electronically with a programmable electronic controller 34, with the controller 34 sending an actuation signal to the solenoid of the valve 32 to open the valve 32 as required. The controller 34 may generally operate as a timer, sending signals to open the valve 32 to operate the present mechanism to feed chemical sticks into the gas well W at predetermined intervals. However, the controller 34 may also receive information from sensors relating to pressure in the well W or wellhead WH, contaminants or other substances entrained in the gas flow from the well, or other factors, using conventional transducer technology for such factors. The controller 34 may be set to certain predetermined threshold conditions, whereupon it sends a signal to open the solenoid valve 32 upon reaching any one or more of those conditions, as desired.

When the solenoid valve 32 is opened, gas flows through the valve 32 to a conveyor-actuating pneumatic cylinder 36. The distal end of the cylinder 36 pushrod is normally fully extended, as shown in solid lines at 38*a* in FIG. 3. However, when pneumatic pressure is received by the cylinder 36, the pushrod is retracted to reposition the distal end at 38*b*, as shown in broken lines in FIG. 3.

The pushrod is connected to a lever arm 42, which is in turn connected to the conveyor drive wheel 40. The lever arm 42 is normally pulled to a right-hand stop position 42*a* (shown in solid lines in FIG. 3) by a tension spring and cable 44. However, when pneumatic pressure is received by the cylinder 36, the cylinder pushrod is retracted to draw the lever arm 42 clockwise (as seen in FIG. 3) to the position 42*b* shown in broken lines. The lever arm 42 engages one of the peripheral holes 46 of the conveyor drive wheel 40 as it swings between positions 42*a* and 42*b*, to rotate the wheel 40 and pull the conveyor belt 16 a corresponding distance. When the solenoid switch 34 is opened, pneumatic pressure is released from the system, allowing the spring and cable 44 to pull the lever arm 42 back to its rest position at 42*a*. The ratchet mechanism releases from the peripheral hole 46 of the conveyor drive wheel 40 during the return stroke of the arm 42, with the wheel 40 and conveyor 16 remaining stationary during the return stroke of the cylinder 36 pushrod and lever arm 42.

Thus, the conveyor 16 moves only in one direction, as shown by the directional arrows in FIG. 3, and moves incrementally one step each time the cylinder 36 is actuated. Each step corresponds to the spacing between each flight 18 on the conveyor 16. It will be seen that the J-shaped flights 18 separate at their outer curved ends as they round the ends of the conveyor 16. The curvatures of the J-shaped ends are oriented upwardly at the idler end 20 of the conveyor 16, as shown in FIG. 2. Thus, the chemical sticks S contained by the conveyor flights 18 are retained by the upwardly curved flights 18 at the idler end 20 of the conveyor 16, and cannot escape from the conveyor 16 at that end 20. Moreover, the immediately adjacent contact of the curved outer ends of the J-shaped flights 18 along the straight runs of the conveyor 16 also preclude escape of the sticks S therefrom along those runs of the conveyor. However, as the flights 18 are spread around the drive end 22 of the conveyor 16, their curved ends are oriented downwardly. This allows the chemical sticks S to roll from the flights 18 to drop into a receiving chute or trough 48, as shown diagrammatically in FIG. 3. Each actuation of the cylinder 36 moves the conveyor 16 a distance equal to the spacing of the flights 18 from one another, thus allowing one, and only one, stick S to drop from the drive end 22 of the conveyor 16 and into the chute or trough 48 at each activation of the system.

Figure 4:
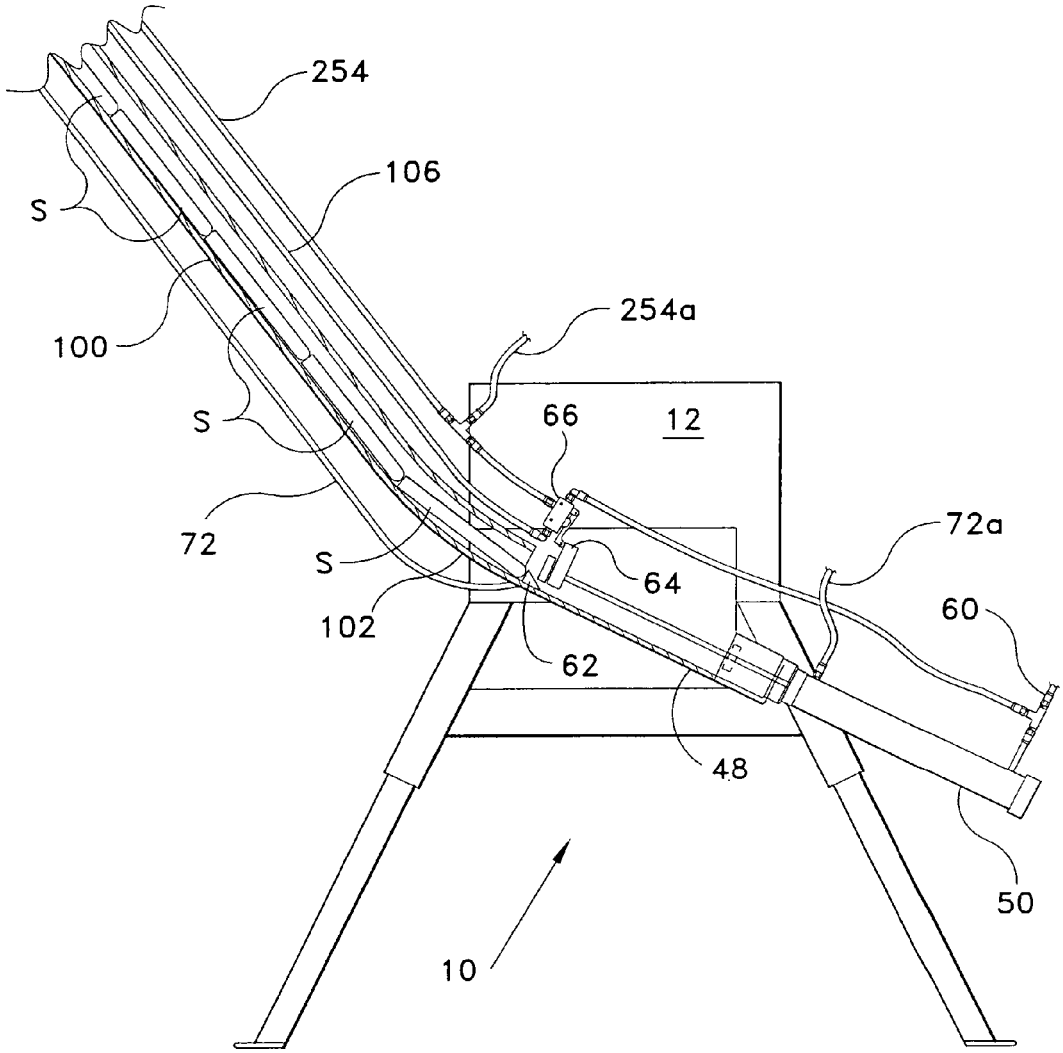
FIG. 4 is an end elevation view of the dispensing end of the stick dispenser, with the stick delivery mechanism for propelling sticks to the top of the wellhead being shown in section.

The chemical stick S dropped into the trough 48 is pushed into the stick transfer tube 100 by a second, stick transfer cylinder 50 located at the lower, cabinet attachment end 102 of the stick transfer tube 100, as shown in FIG. 4. The stick transfer cylinder 50 is actuated in sequence after the actuation of the automated stick dispensing mechanism discussed above. Returning to FIG. 3, it will be noted that a pair of switch actuating pushrods, respectively 52 and 54, extend in opposite directions from the distal end of the lever arm 42. Each of these switch pushrods 52 and 54 actuates a separate pneumatic switch to control gas flow to other cylinders in the system. The left-hand switch pushrod 52 actuates to open pneumatic switch 56 which supplies pressure to the stick transfer cylinder 50, when the pushrod is in its leftward position 52*a* to actuate the switch contact as shown in broken lines in FIG. 3.

It will be noted that gas from the solenoid valve 32 passes through a tee 58, before arriving at the conveyor-actuating cylinder 36. The tee 58 splits the gas supply to pass to the cylinder 36, and also to the stick transfer cylinder pneumatic switch 56. When the pneumatic switch 56 is opened, gas flows through the switch 56 to the stick transfer cylinder 50 via the pneumatic line 60. As the pneumatic switch 56 cannot open to allow gas to flow therethrough until its actuating lever is contacted by the switch pushrod 52, it will be seen that the switch 56 will remain closed to pneumatic flow therethrough until the end of the conveyor advance stroke due to the operation of the conveyor actuation cylinder 36 and corresponding lever arm 42 movement. Thus, this operation is sequential, with the action of the stick transfer cylinder 50 being delayed until after the conveyor 16 has advanced to drop a single chemical stick S into the chute or trough 48.

When the stick transfer cylinder 50 is actuated, its pushrod extends to push the chemical stick S out of the chute or trough 48 and into the lower, cabinet attachment end 102 of the stick transfer tube 100, as shown in FIG. 4. As the lowermost stick S is pushed into the lowermost end 102 of the transfer tube 100, it contacts the previously lowermost stick S and pushes it farther up the tube 100. This process continues, with all of the sticks S being aligned sequentially in a linear array in the relatively narrow tube 100, the topmost stick S being pushed from the top or wellhead attachment end 104 of the tube 100 to drop into the wellhead WH, as described in detail further below. The first or lowermost stick S is precluded from sliding back into the chute or trough 48 by a beveled stop 62 disposed at the lowermost end 102 of the stick transfer tube 100. As the pushrod of the stick transfer cylinder 50 pushes the first stick S into the tube 100, the rearward end of the stick S passes over the stop 62 and drops beyond the stop. When the pushrod is retracted when the cylinder 50 returns to its rest position, the lowermost stick S slides back a short distance until it comes into contact with the stop 62, whereupon further downward and rearward of the stick(s) S is precluded.

It will be noted in FIG. 4 that the distal end of the stick transfer cylinder pushrod includes a pneumatic switch actuator arm 64 extending therefrom, similar to the pneumatic switch actuator pushrods 52 and 54 of FIG. 3. When the stick transfer cylinder 50 is actuated and its pushrod is fully extended to push the lowermost chemical stick S from the trough or chute into the lowermost end 102 of the transfer tube 100, the switch actuator arm 64 reaches the pneumatic transfer switch 66. This switch 66 allows gas to flow upwardly along the transfer tube 100 to the stick passage mechanism 200 at the top of the wellhead WH via the stick passage supply line 106, when it is actuated by the extension of the cylinder 50 pushrod to allow pneumatic pressure to flow therethrough. A detailed illustration of the operation of the cylinders and valves at the top of the wellhead WH is shown in FIG. 6, with a discussion of the operation being provided further below.

Figure 5:
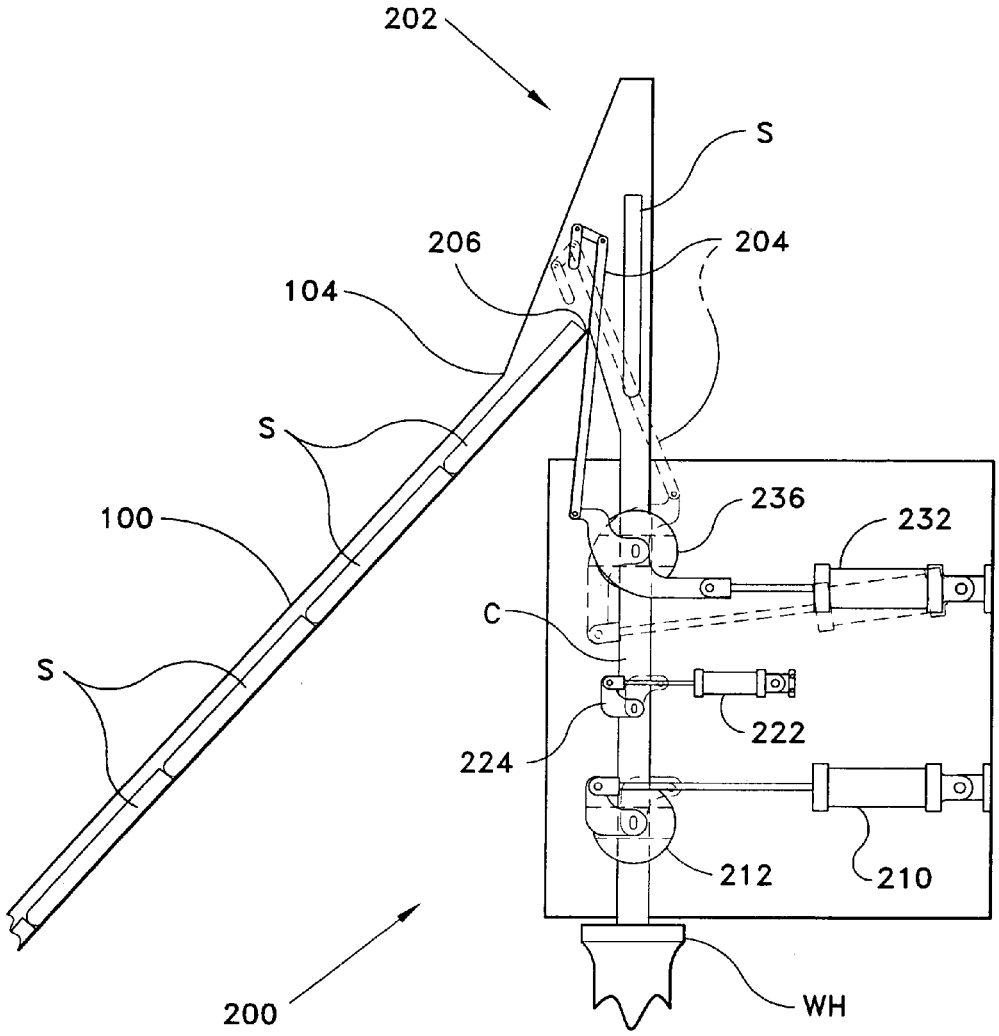
FIG. 5 is an elevation view in partial section of the top of the wellhead, showing the system for transferring chemical sticks from the delivery tube to the top of the wellhead.

The upper wellhead attachment end 104 of the stick transfer tube 100 is secured to the top of the wellhead WH by a stick transition housing 202, illustrated in FIG. 5 of the drawings. As the chemical sticks S are pushed upwardly to the upper end 104 of the transfer tube 100, they enter the stick transition housing 202. A stick kickover arm 204 is disposed within the housing 202, and acts to push or kick the topmost chemical stick S over from the upper end 104 of the transfer tube 100 into the upper end of the wellhead WH where it can pass through the valves of the stick passage mechanism 200. The stick kickover arm 204 is mechanically linked to the uppermost valve in the stick passage mechanism 200, and oscillates to kick the lower end of the topmost stick S over the upper lip 206 at the top of the transfer tube 100 where it meets with the stick transition housing 202 when the upper valve is moved to an open position to allow the topmost stick S to drop past the upper valve and into the upper end of the wellhead WH, as discussed below. A slot may be provided in the lower portion of the transition housing 202 for clearance for the kickover arm 204, or alternatively the housing 202 may be enlarged to provide a complete enclosure for the mechanism throughout its operating cycle.

Figure 6:
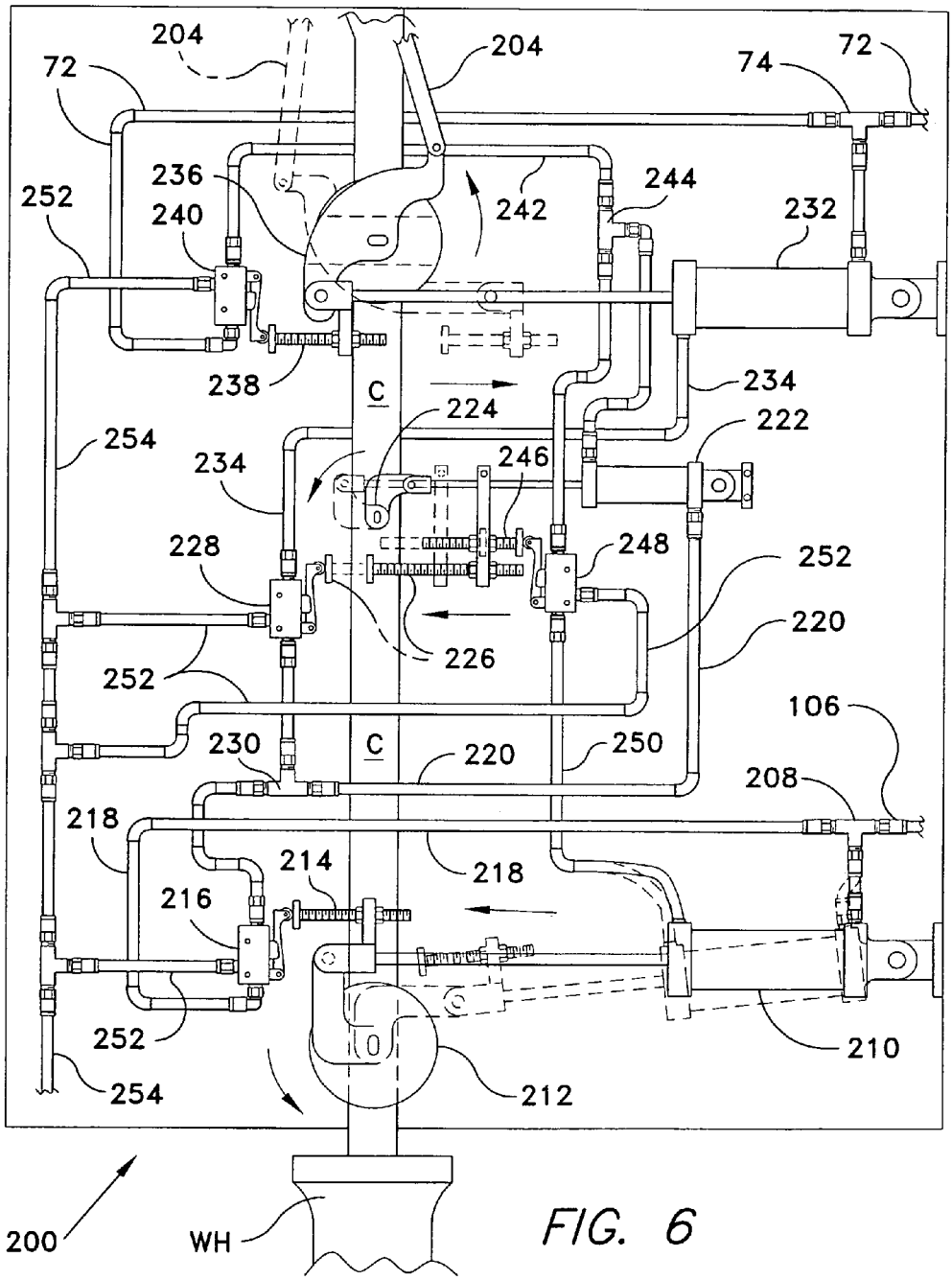
FIG. 6 is a detailed elevation view of the pneumatic system for operating the valves at the top of the wellhead to open the well for the delivery of chemical sticks therein.

FIG. 6 of the drawings provides an illustration of the operation of the stick passage mechanism 200, which allows the chemical sticks S to enter the well without releasing well pressure. The stick passage mechanism 200 includes a series of three actuating cylinders which respectively control three separate valves in the wellhead WH. These cylinders are actuated sequentially by pneumatic pressure received from the supply line 106 when the pneumatic transfer switch 66 is actuated by the stick transfer cylinder 50 to allow gas to flow up the stick passage mechanism supply line 106, as shown in FIG. 4. The supply line 106 is continued in FIG. 6, where it supplies pneumatic pressure to operate the three valves of the mechanism 200. Specifically, the supply line 106 enters FIG. 6 at the lower right hand side thereof, connecting with a tee 208 which in turn connects to a first or lower wellhead valve actuator cylinder 210. The cylinder 210 is mechanically linked to a normally open first or lower wellhead valve 212 in the wellhead WH. The open orientation of the valve 212 is indicated within the wellhead WH pipe in broken lines, although the normally open position of the external valve 212 and actuator 210 linkage is shown in solid lines in FIG. 6.

When the first wellhead valve actuator cylinder 210 is pressurized from the supply line 106, its pushrod is extended to rotate the first or lower wellhead valve 212 to a closed position, as shown by the solid line positions of the cylinder 210 pushrod and the actuating arm of the lower or first valve 212. The pushrod has a pneumatic switch contact arm 214 extending therefrom, similar to the arms 52 and 54 shown in FIG. 3. When the switch lever is actuated by contact with the contact arm 214, gas flows to the switch 216 from the first pneumatic switch supply line 218 which branches from the tee 208. Gas continues through the switch 216 via an intermediate supply line 220 to provide pressure to an intermediate cylinder 222, which controls an intermediate vent valve 224. This valve 224 is normally closed, but when opened by the intermediate actuator cylinder 222 it vents the gas from the intermediate chamber C of the upper wellhead WH between the first 212 and second 236 valves. This gas is normally at well pressure, and must be vented before opening the upper or second valve of the system.

When pneumatic pressure is applied to the intermediate valve actuator cylinder 222, its pushrod extends to open the intermediate vent valve 224 and release the well pressure from the intermediate chamber C of the upper wellhead WH, as described above. Due to the sequencing of the valves by means of the pneumatic switches, it will be seen that the first or lower valve 212 must be closed to shut off gas flow from the well into the upper portion of the wellhead, before pneumatic pressure can flow to the intermediate valve actuating cylinder 222 to open the intermediate vent valve 224. Vented gas may be routed to a collection point via a vent return system, described further below for the various actuating cylinders used in the system.

The pushrod of the intermediate cylinder 222 also includes a switch contact pushrod 226 extending therefrom. When the cylinder 222 pushrod is fully extended, the contact pushrod 226 reaches the switch contact for the intermediate valve pneumatic switch 228, as shown in broken lines in FIG. 6, allowing gas flow through that switch 228. Gas flows from a tee 230 in the intermediate vent cylinder supply line 220 to the intermediate valve pneumatic switch 228, and thence through the switch 228 to the upper or second valve actuating cylinder 232 via a second cylinder supply line 234.

The second valve-actuating cylinder 232 is linked to the second or upper valve 236 of the wellhead valve system 200. This valve 236 is normally closed, as indicated by the broken line position of the valve across the wellhead pipe in FIG. 6. When gas is applied to the pushrod end of the cylinder 232, the pushrod retracts in the cylinder 232 to rotate the second or upper valve 236 to its open position, as shown by the broken line position of the arm of the second or upper valve 236 in FIG. 6. The opening of the upper valve 236 opens the central chamber C of the wellhead pipe to the stick transition housing 202, shown in FIG. 5. At the same time, the rotation of the arm of the upper valve 236 cycles the stick kickover arm 204 from its rest position, with the lower end of the arm 204 in this position shown in solid lines in FIG. 6 and broken lines in FIG. 5. When the kickover arm 204 oscillates due to the rotation of the valve 236, it moves to the broken line position shown in FIG. 6 and the solid line position in FIG. 5, kicking the topmost chemical stick S over the threshold 206 of the upper end of the transfer tube 100 to fall through the open upper valve 236 and into the central chamber C of the wellhead pipe between the upper and lower valves 236 and 212.

Reversal of the above-described sequence is initiated by the programmable controller 34, with the reversal procedure being initiated within the stick storage and dispensing cabinet as shown in FIG. 3. After a suitable duration (e.g., two minutes, more or less) to allow time for the above sequence to occur, the programmable controller 34 terminates electrical power to the solenoid shutoff valve 32, thereby shutting off gas pressure to the conveyor-actuating cylinder 36. Pressure from the cylinder 36 may return via the supply line between the cylinder and the solenoid valve 32, where it is vented to a suitable location (not shown). It will be seen that the reduction of pressure in the supply line between the cylinder 36 and the solenoid valve 32, also allows the pressurized gas in the remainder of the system to be relieved through the various lines and pneumatic switches, e.g., line 60 and switches 56 and 68 of FIG. 3, etc. Thus, the various actuating cylinders of the present system may be reversed by the application of pneumatic pressure to their opposite ends without the initial actuating pressure resisting their return.

In the case of the conveyor actuating cylinder 36 of FIG. 3, once its internal pressure has been vented the spring and cable linkage 44 draws the pushrod to an extended position, as shown in solid lines in FIG. 3. The lever arm 42 thus rotates slightly counterclockwise (as seen in FIG. 3) to return to its at rest position, and ratchets past the conveyor drive wheel 40 with the conveyor 16 remaining stationary during the return of the lever arm 42.

As the lever arm 42 moves counterclockwise to its rest position, the second pneumatic switch pushrod 54 contacts a second pneumatic switch 68, allowing gas to flow through that switch 68 from a reversal supply line 70 extending from the tee 30. Gas at regulated pressure flows through the reversal supply line 70 and the second pneumatic switch 68 to a reversal output line 72, and thence to the retraction end of the stick transfer cylinder 50 via a tee (not shown) and a reversal line branch 72*a*. This retracts the pushrod of the cylinder 50 to position it behind the next chemical stick S released by the conveyor 16, when the system is next actuated. This also retracts the actuator arm 64 from the pneumatic transfer switch 66, thereby closing off gas pressure and flow to the stick passage mechanism 200 atop the wellhead WH, via the now closed line 106.

The reversal output line 72 continues up the transfer tube 100 to the stick passage mechanism 200 at the top of the wellhead WH, where it connects to a tee 74 to the attachment end of the upper or second valve actuating cylinder 232, as shown in FIG. 6. Return gas flow into the now unpressurized cylinder 232, results in the extension of the pushrod to close the second or upper valve 236, thus closing the top of the central or intermediate chamber C of the wellhead WH below the valve 236. This results in the switch contact pushrod 238 extending to contact the upper pneumatic switch 240, thus allowing gas to flow through that switch 240 from the valve return actuation line 72 to an intermediate return line 242 extending between the upper pneumatic switch 240 and the return side of the intermediate valve 222, via a tee 244.

Actuation of the intermediate or vent valve-actuating cylinder 222 retracts the pushrod to close the intermediate valve 224. This shuts off flow from the intermediate or central chamber C of the wellhead, between the upper and lower valves 236 and 212. Thus, the central chamber C is closed and readied for the opening of the first or lower valve 212 in sequence, as described below.

As the actuation cylinder 222 for the intermediate or central chamber vent valve 222 returns to its normal position, its pushrod retracts to move a second intermediate cylinder pushrod contact 246 into contact with an intermediate return line pneumatic switch 248. This causes the switch 248 to allow return gas to flow therethrough, via a first cylinder return line 250. Pressurization of the lower or first cylinder 210 causes that cylinder 210 to retract, thus rotating the first or lower valve 212 to a closed position as shown by the broken line showing of the cylinder pushrod and actuating arm in FIG. 6. This also releases the actuating switch pushrod 214 from the first or lower valve pneumatic switch 216, shutting off gas flow through that switch 216 in readiness for the next cycle of operation.

The stick passage mechanism 200 of FIG. 6 also includes a switch vent manifold 252, which interconnects all of the various pneumatic switches 216, 228, 240, and 248 to a single vent line 254. The vent line 254 continues as vent line 254 along the stick transfer tube 100, as shown in FIG. 4, to vent the pneumatic transfer switch 66. The vent system continues as a branch 254*a* to the actuating system in the stick storage and dispensing cabinet 10, as shown in FIG. 3, where it connects with the vent ports of the pneumatic switches 56 and 68, and thence to the solenoid shutoff valve 32 for capture or disposal.

Figure 7A:
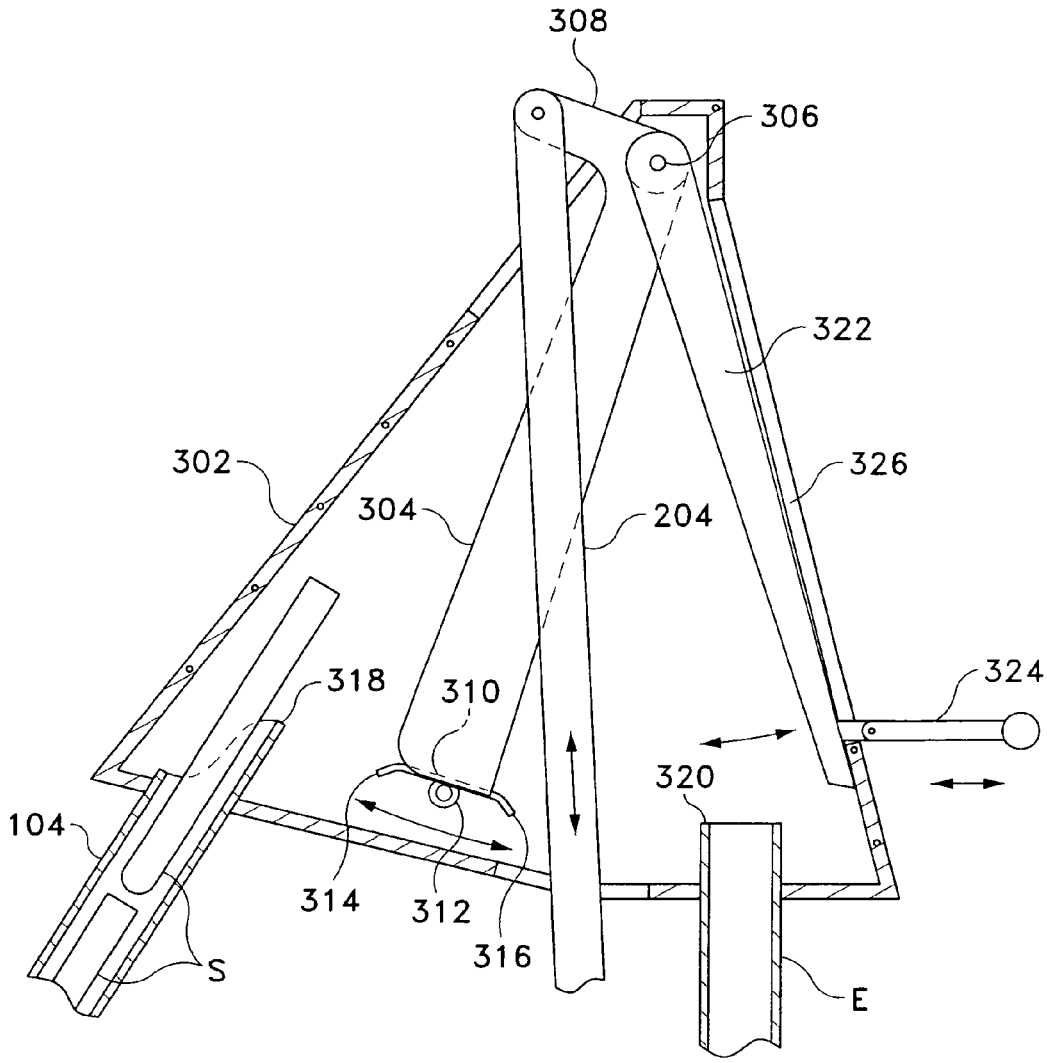
FIG. 7A is a side elevation view in partial section of an alternative embodiment of the stick transfer housing at the top of the wellhead, showing the operation of the mechanism therein.
Figure 7B:
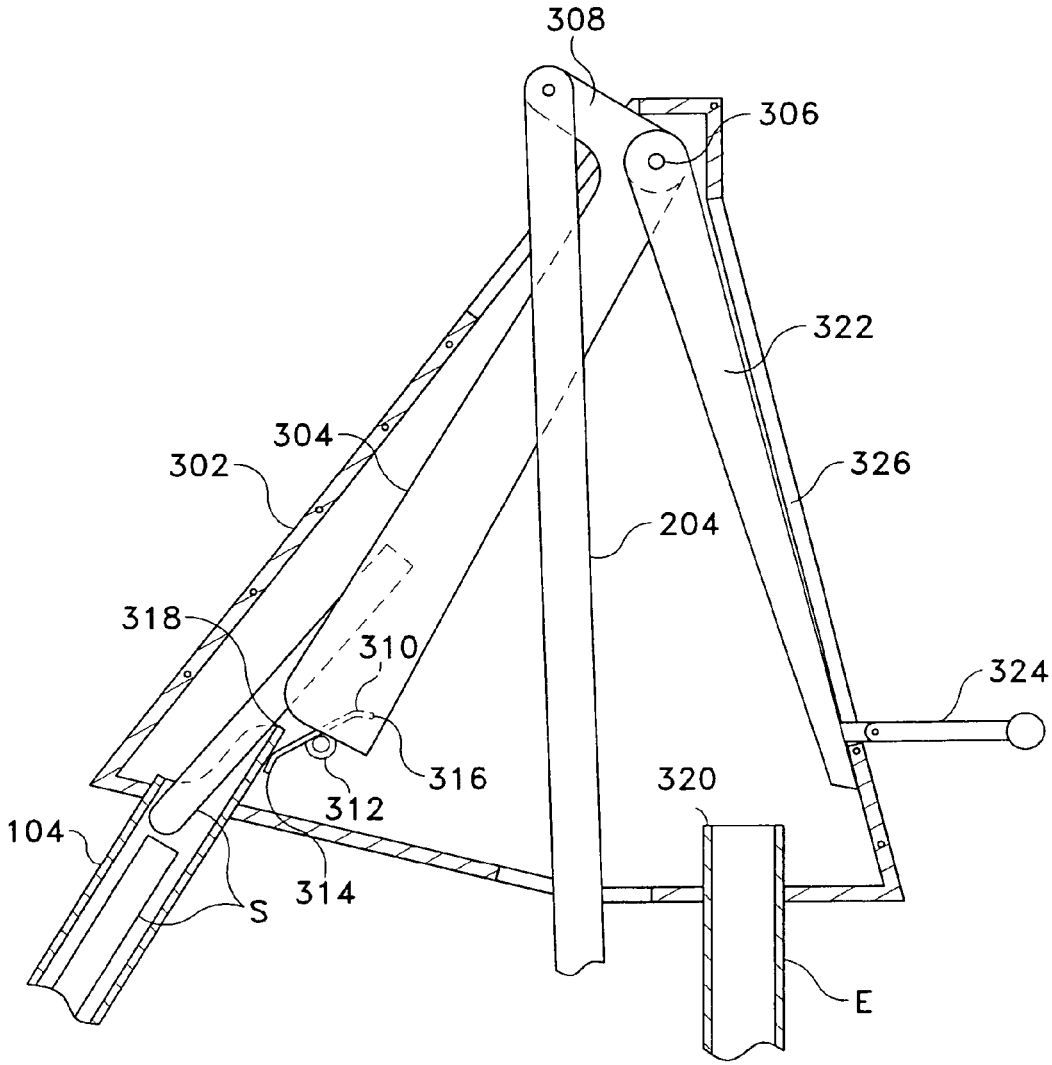
FIG. 7B is a side elevation view in partial section of the stick transfer housing of FIG. 7A, showing the initial approach of the stick transfer chute to the upper end of the stick transfer tube.
Figure 7C:
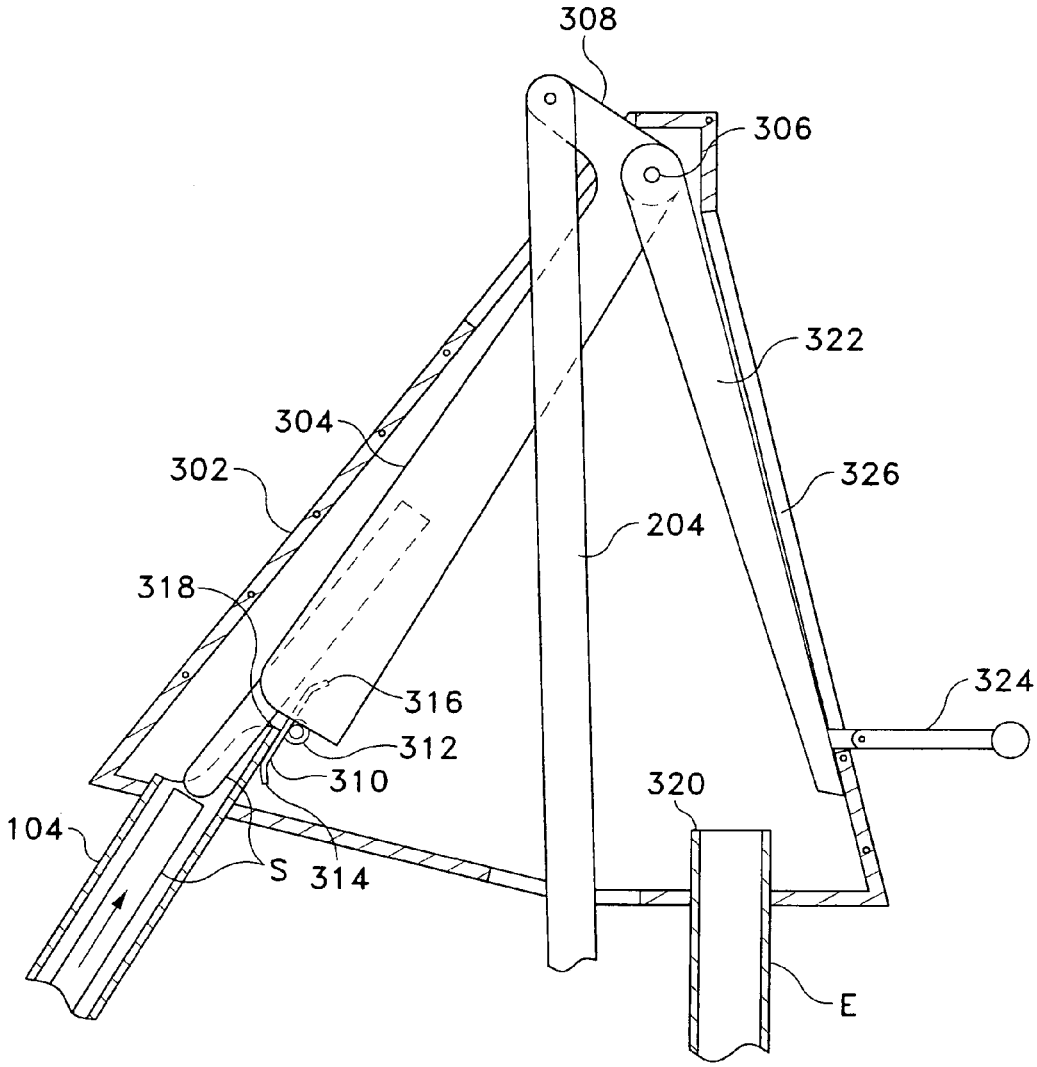
FIG. 7C is a side elevation view in partial section of the stick transfer housing of FIGS. 7A and 7B, showing the alignment of the stick transfer chute with the stick transfer tube and insertion of a chemical stick into the stick transfer chute.
Figure 7D:
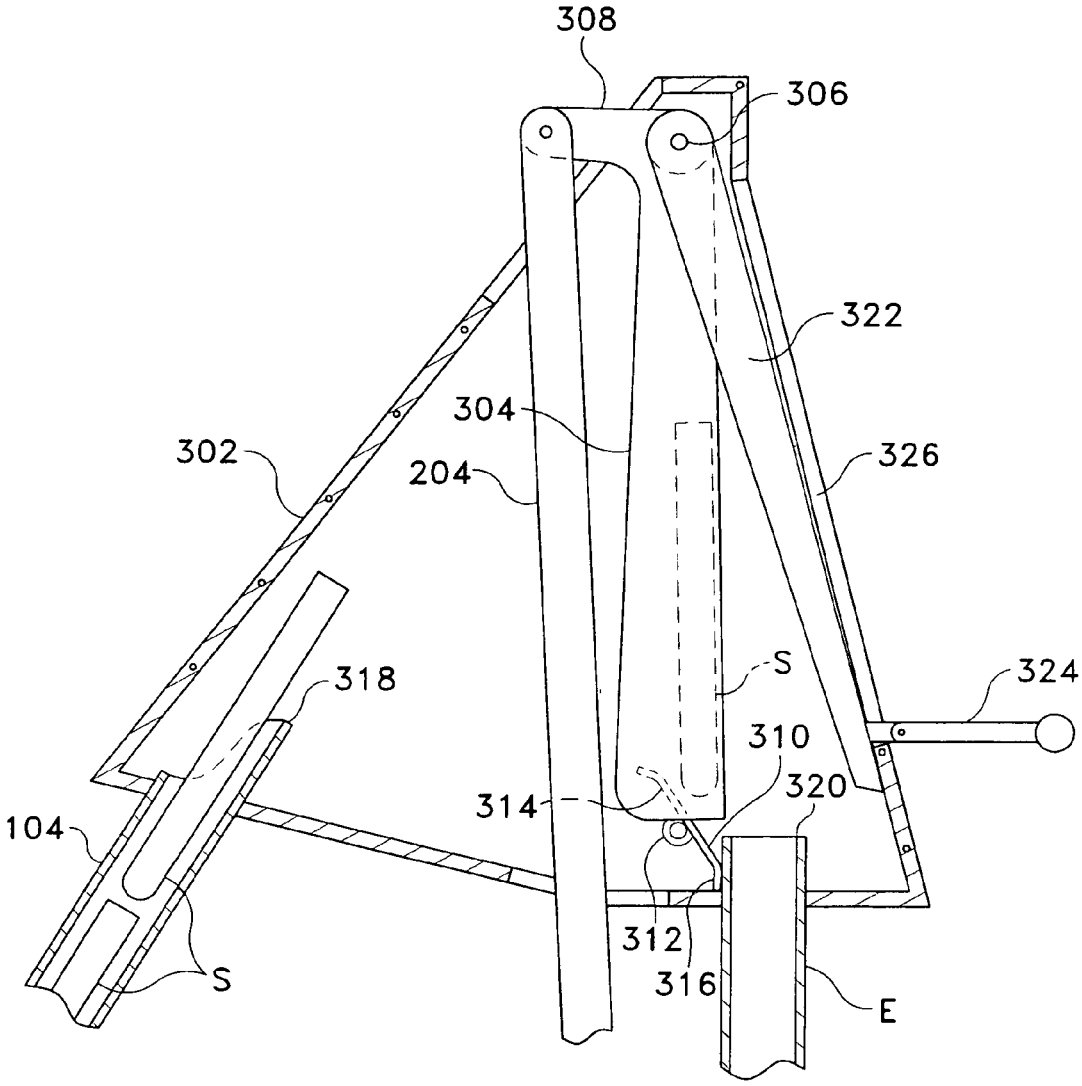
FIG. 7D is a side elevation view in partial section of the stick transfer housing of FIGS. 7A through 7C, showing the initial approach of the stick transfer chute to the upper end of the wellhead pipe.
Figure 7E:
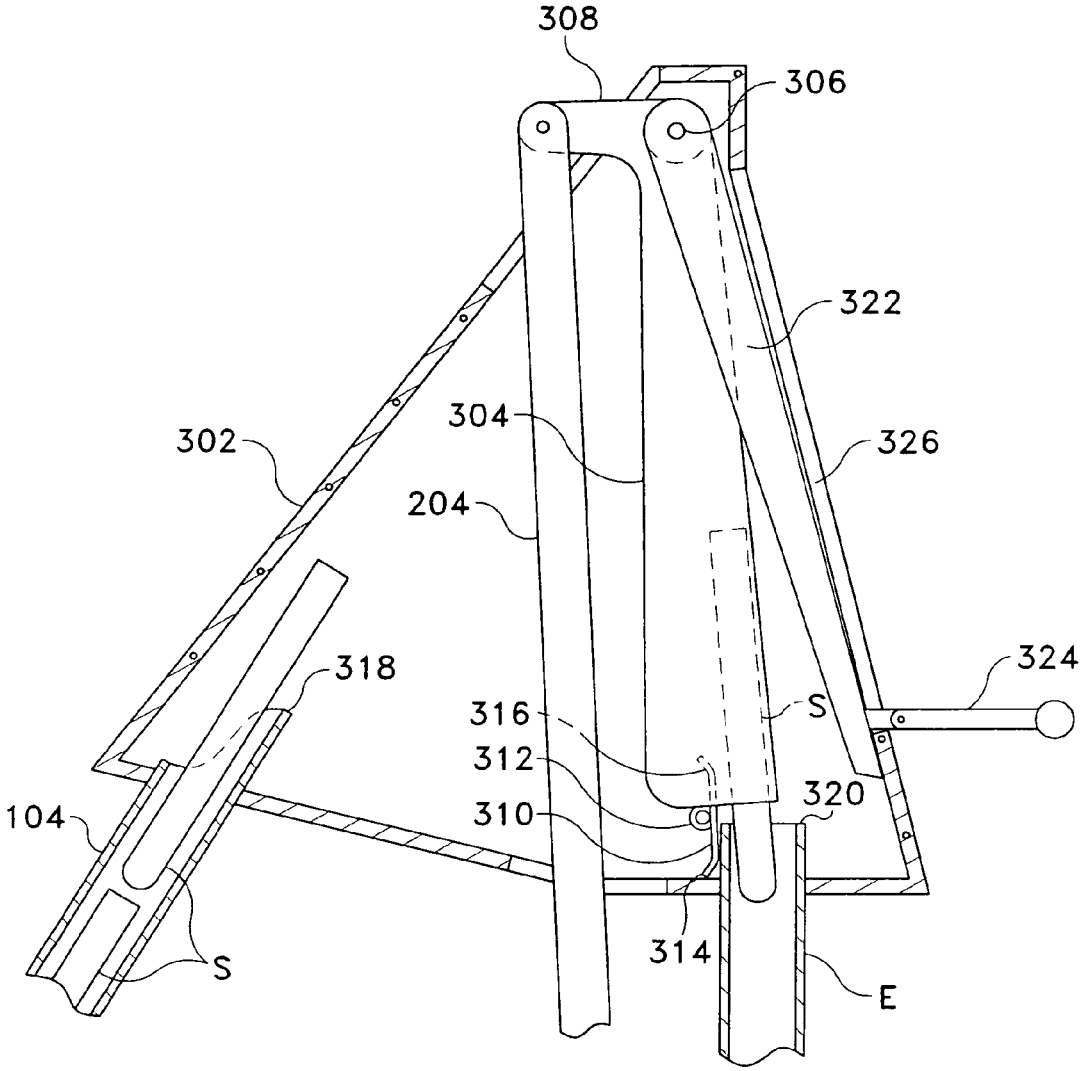
FIG. 7E is a side elevation view in partial section of the stick transfer housing of FIGS. 7A through 7D, showing the alignment of the stick transfer chute with the wellhead pipe and the dropping of a chemical stick into the wellhead pipe.
Figure 7F:
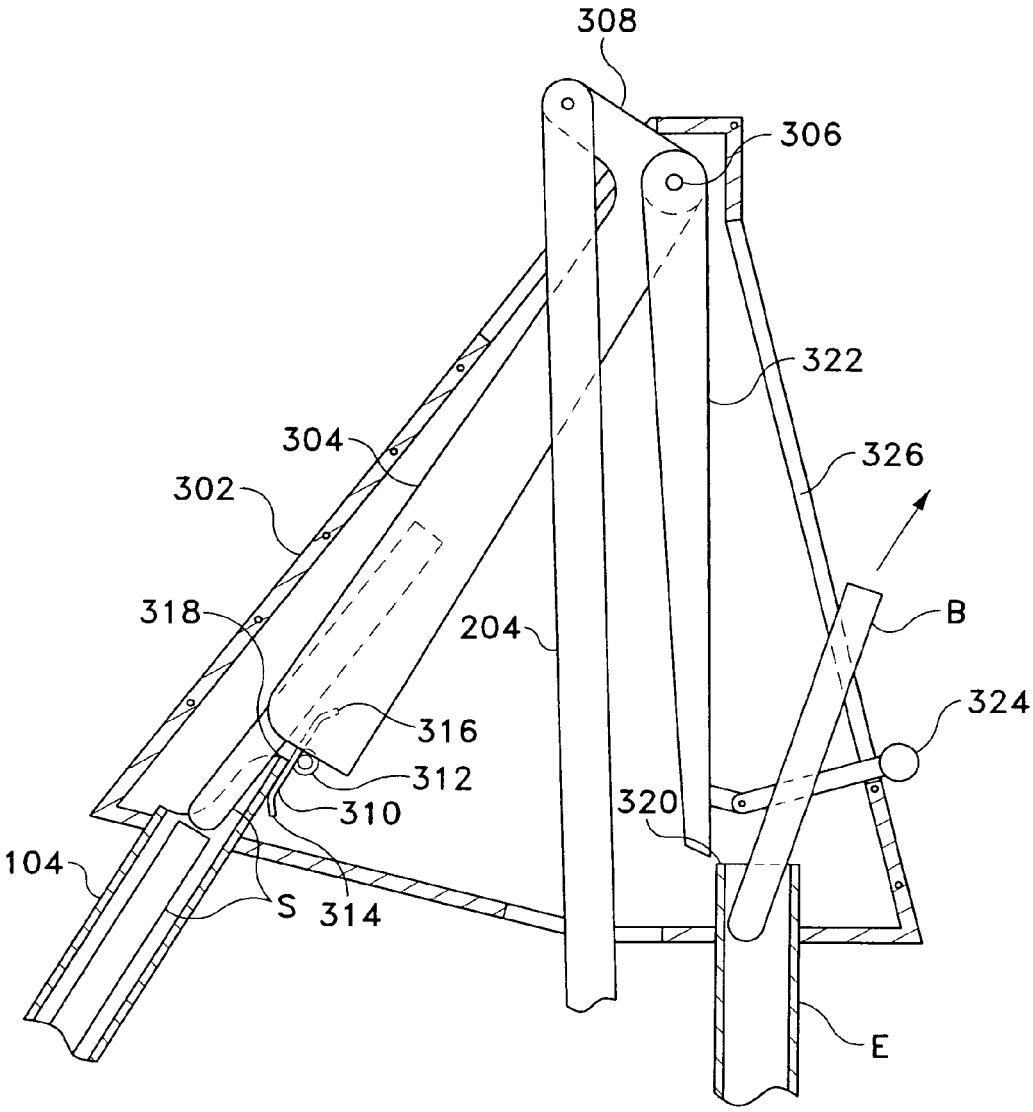
FIG. 7F is a side elevation view in partial section of the stick transfer housing of FIGS. 7A through 7E, showing the operation of the stick ejection guide door and the release of a "blown" stick from the wellhead pipe.

FIGS. 7A through 7E illustrate the operation of an alternative stick transfer housing 302, with FIG. 7F showing the operation of a mechanism for ejecting a jammed stick from the top of the wellhead. The upper end 104 of the stick transfer tube extends into the bottom of the housing 302, with the upper end E of the wellhead pipe (i.e., the portion extending above the second or upper valve 236) also extending into the bottom of the transfer housing 302. A stick transfer chute or sleeve 304 is pivotally secured within the housing 302 by a lateral pivot pin 306 within the top of the housing. An actuating arm 308 extends from the pivot end of the transfer chute or sleeve 304, with the arm 308 being pivotally connected to the upper end of the stick kickover arm 204. The arm 204 is connected at its lower end to the upper valve 236 and actuated therefrom, as shown in FIGS. 5 and 6.

When the upper valve 236 opens, the stick kickover arm 204 is lifted due to valve arm rotation to raise the distal end of the transfer chute actuating arm 308, thereby pivoting the stick transfer chute or sleeve 304 to the left to accept a chemical stick S from the upper end 104 of the transfer tube, as shown in FIGS. 7B and 7C. The chute or sleeve 304 is open along its lower left side to accept a stick S somewhat laterally therein as the chute pivots toward its leftmost position, as shown in FIG. 7C. A retaining flap 310 is pivotally secured medially and laterally across the otherwise open lower end of the transfer chute or sleeve 304, and is biased to a neutral position (as shown in FIG. 7A) by a coil spring 312 or the like disposed about its pivot. The flap 310 serves to retain a chemical stick S within the chute 304 during the transfer of the stick S from the transfer tube to the wellhead pipe. The flap 310 includes two opposed downturned edges, respectively 314 and 316. These two flap edges 314 and 316 make periodic contact with the raised lips or edges 318 of the transfer tube wellhead attachment end 104 within the lower left portion of the housing 302, and of the raised lips or edges 320 of the wellhead pipe upper end E within the lower right portion of the housing 302, depending upon the motion of the pivoting transfer chute or sleeve 304 during its operation.

In FIG. 7B, the upper valve 236 (shown in FIGS. 5 and 6) has nearly completely opened, thus raising the stick kickover arm 204 and pivoting the stick transfer chute or sleeve 304 clockwise, i.e., so that its lower end is adjacent the upper end 104 of the stick transfer tube. As this occurs, the downturned edge 314 of the stick retaining door or flap 310 makes contact with the raised lip 318 of the stick transfer tube upper end 104, causing the stick retaining flap 310 to rotate counterclockwise about its biasing spring 312 and pivot pin, thereby lowering the edge 314 of the flap 310 to accept a chemical stick S into the pivoting stick transfer sleeve or chute 302. The transfer chute 302 is shown at its leftmost position in FIG. 7C, i.e., when the upper valve 236 is fully opened, with the stick retaining flap 310 rotated or deflected substantially 900 to its normally closed position in order to allow unrestricted passage of a chemical stick S into the transfer chute or sleeve 304.

As the upper valve 236 closes, it lowers the stick kickover arm 204, thereby pivoting the stick transfer chute 304 away from the upper end 104 of the stick transfer tube and toward the upper end 320 of the wellhead pipe extension E. As this occurs, the biasing spring 312 of the stick retaining flap or door 310 urges the door to its neutral position to close off the lower end of the stick transfer chute 304, generally as shown in FIG. 7A. This serves to retain any chemical stick S that has been inserted into the stick transfer chute 304 within the chute until the stick retaining flap or door 310 is pivotally opened again.

When the valve 236 is nearly fully closed, the downturned lip 316 of the stick retaining door or flap 310 makes contact with the raised lip or edge 320 of the wellhead extension E, causing the flap 310 to rotate clockwise and lowering its contact edge 316, generally as shown in FIG. 7D. It will be seen that this raises the opposite lip or edge 314 of the door or flap 310, thus causing the lower end of any chemical stick S resting thereon and retained within the stick transfer chute 304, to slide laterally across the flap 310 from the high side or edge 314 toward the lower side or edge 316.

When the upper valve 236 is completely closed, the stick transfer chute 304 reaches its extreme travel over the upper end E of the wellhead extension, with the stick retaining door or flap 310 being deflected substantially 90° to its normally closed position across the lower end of the stick transfer chute 304, as shown in FIG. 7E. This allows the chemical stick S being carried within the transfer chute 304 to drop from the chute 304 into the upper end E of the wellhead, completing the delivery of the chemical stick S to the wellhead.

At times, a chemical stick will catch or jam within the valve mechanism at the top of the wellhead, or perhaps at some distance down within the well or wellhead pipe. Obviously, it is essential to remove the jammed stick from the well or wellhead, in order to continue proper treatment of the well. The inherent gas pressure within the well, nominally on the order of a few hundred pounds per square inch (psi), is conventionally used to blow the jammed stick from the well. The automated stick loader includes means for clearing such a jammed stick from the well or wellhead, as well as clearing the stick from the stick transfer housing. While this stick clearance apparatus is shown in FIG. 7F for the stick transfer housing 302 and its associated mechanism, it will be seen that it may also be applied to the stick transfer housing 202 and mechanism of FIG. 5, if so desired.

The jammed stick clearance mechanism of FIG. 7F comprises a normally closed, pivotally mounted stick ejection door 322, which pivots upon the same pivot axis 306 as the stick transfer chute or sleeve 304. The door 322 includes an actuating handle 324 extending therefrom, and normally closes a stick blowout opening 326 in the side of the housing 302. In the event that a stick becomes caught or jammed in the wellhead or well pipe, the well worker need only open the stick ejection door 322 generally as shown in FIG. 7F, and disconnect the upper valve 236 from its actuator 232 (shown in FIGS. 5 and 6). This is easily accomplished by pulling the connector pin in the linkage at the end of the actuator pushrod where it connects to the valve actuating arm, or some other disconnecting point may be used as desired. The worker then opens the upper valve 236, which allows pressurized gas to escape from the well through the open lower valve 212. The opening of the upper valve 236 also raises the stick kickover arm 204, thus pivoting the stick transfer chute or sleeve 304 toward the stick transfer tube or pipe and clear of the upper end E of the wellhead. The pressurized gas from the well blows the stick from the well or wellhead, with the access door 322 deflecting the blown stick B from the mechanism. Once the blown stick B has been freed from the well, the upper valve 236 is closed and reconnected to its actuator 232 and the access door 322 is closed, to return the mechanism to its normal configuration for continued operation. While this operation must be conducted at the stick transfer housing above the wellhead with the mechanism illustrated in FIGS. 7A through 7F, it will be seen that means may be provided for disconnecting and opening the upper valve and blowout door remotely from the surface, if desired.

The present chemical stick loader provides a much-improved method of periodically dispensing soap sticks and/or other chemical sticks into a gas well or the like. Once the present device is installed at a gas well, the user need only open the doors 75 of the ground-based cabinet 10 and insert a chemical stick into each of the flights 18 of the conveyor 16; such access is shown in FIG. 2 of the drawings. The hand wheel at the idler end 20 of the conveyor 16 may be used to move the conveyor for access to each of the flights 18 thereon. When the conveyor 16 has been loaded, the doors 75 are closed and electrical power (e.g., solar, battery, etc.) provided to the previously programmed (e.g., time settings, etc.) controller 34. The system may be actuated a sufficient number of times as to push a number of sticks up the transfer tube 100 to the top of the wellhead WH, or the transfer tube may be filled manually by pushing sticks up the tube in sequence until it is filled.

At this point, the machine will operate completely automatically without further human intervention. The stick dispensing and loading process begins when the controller 34 actuates the solenoid valve 32 to open the gas valve therein, which operation has been described in greater detail further above and is illustrated generally in FIG. 3. The conveyor-actuating cylinder 36 advances the conveyor 16 a distance equal to one flight 18, causing a chemical stick S to drop into the trough or chute 48 at the dispensing end of the cabinet 10. The pneumatic sequencing system then actuates the stick transfer cylinder 50 to push the stick S just dispensed from the conveyor into the bottom end of the transfer tube 100, as shown in FIG. 4.

As the transfer tube 100 is filled with sticks S in a linear array, the insertion of another stick S in the bottom of the tube 100 causes the topmost stick S in the tube 100 to push upwardly into the stick transition housing 202, shown in FIG. 5. Pneumatic pressure is also sent to the stick passage mechanism 200 atop the wellhead WH via the pneumatic line 106.

The pneumatic pressure received at the housing 202 (shown in detail in FIG. 6) sequentially actuates the first or lower actuator cylinder 210 to close the first or lower valve 212, actuates the intermediate actuator cylinder 222 to open the intermediate vent valve 224, and then actuates the upper or second actuator cylinder 232 to open the upper or second valve 236. The operation of the second valve 236 simultaneously pushes or carries the topmost chemical stick S over the upper edge 206 of the transfer tube 100 by means of a mechanical linkage 204 extending upwardly from the top valve 236, dropping the stick S through the open upper valve 236 to rest atop the closed lower valve 212.

After a suitable interval to allow the above operation to be accomplished, the controller 34 terminates electrical power to the pneumatic solenoid 32, causing it to release the pressure in the conveyor-actuating cylinder 36. The cylinder 36 is returned to its extended rest position by the spring and cable linkage 44 in the cabinet 10. The return of the cylinder 36 to its rest position also results in the actuation of a second pneumatic switch 68 in the cabinet 10, which sequentially pressurizes the opposite sides of the various cylinders 232, 222, and 210 in the stick passage mechanism 200 at the top of the wellhead WH. The sequential actuation of the cylinders 232, 222, and 210, results in (a) the closing of the upper or second valve 236; (b) the closure of the intermediate vent valve 224, thereby readying the intermediate chamber C of the wellhead WH to receive gas pressure from the well; and (c) the opening of the first or lower valve 212 to receive gas pressure from the wellhead WH, and also allowing the chemical stick S previously resting atop the closed first valve 212 to fall through the now open valve 212 and into the well W. In the relatively rare event of a jammed stick in the well or wellhead, the stick may be blown out from the wellhead as described above. It is only necessary to manually open the stick ejection door and the upper valve, as the lower valve is normally open.

In conclusion, the present automated chemical stick loader for gas wells provides a much improved and much safer system for the chemical treatment of gas wells and the like. The location of the chemical stick storage and dispensing cabinet at ground level allows the field worker to replenish the supply of chemical sticks therein, adjust or reprogram the controller, and/or perform other maintenance on the cabinet portion of the device without need to climb a ladder to the top of the wellhead in perhaps inhospitable conditions. The permanent, fixed attachment of the stick transfer tube between the ground-based storage and dispensing cabinet and the mechanism at the top of the wellhead also provides greater reliability for the present system.

Moreover, the use of the readily available pressurized gas from the wellhead to actuate the present system greatly simplifies the system by precluding need for an additional power source. The gas pressure is regulated to a relatively low pressure, e.g., twenty psi or so, thereby providing greater safety in the field. The present device also draws very little electrical power, with its electrical needs being handled easily by a solar panel installation at the gas well site.

While double-acting cylinders are described herein as the valve actuating devices, it will be seen that single-acting cylinders may be used, with two such cylinders acting on each valve to operate the valve in its alternate directions of travel. Alternatively, hydraulic cylinders or other means (e.g., electric actuators, or pneumatic cylinders using ambient air) may be used to actuate the various valves of the present system, with the additional power requirements being handled by a generator powered by natural gas from the well. However, such a system would greatly increase the complexity of the present system, and would result in higher maintenance time and costs. The present system, with its power requirements being handled completely by pneumatic pressure available at the well, provides a straightforward means of automatically treating a remotely located gas well, while minimizing hazards to field workers during routine maintenance and replenishment of the equipment.

It is to be understood that the present invention is not limited to the embodiments described above, but encompasses any and all embodiments within the scope of the following claims.

We claim:

1. An automated chemical stick loader for a gas well, the well having an elevated wellhead, the loader comprising:

a ground-based and ground-accessed stick storage and dispensing cabinet, said cabinet having a stick dispensing end;

a sequentially actuated stick dispensing mechanism disposed within said cabinet;

a sequentially actuated stick passage mechanism adapted for being disposed atop the wellhead;

a stick transfer tube permanently affixed to and extending between said cabinet and the stick passage mechanism, said transfer tube having a cabinet attachment end and a wellhead attachment end opposite the cabinet attachment end;

a stick transfer mechanism disposed at the stick dispensing end of said cabinet and communicating with the cabinet attachment end of said transfer tube; and an automated stick dispensing control system disposed within said cabinet and communicating with said stick dispensing mechanism within said cabinet.

2. The automated chemical stick loader according to claim 1, wherein said control system comprises a programmable electronic controller.

3. The automated chemical stick loader according to claim 1, wherein said stick dispensing mechanism, said stick transfer mechanism, and said stick passage mechanism are each pneumatically actuated.

4. The automated chemical stick loader according to claim 3, further including a pneumatic pressure regulator disposed within said cabinet, communicating with said stick dispensing mechanism, said stick transfer mechanism, and said stick passage mechanism.

5. The automated chemical stick loader according to claim 1, further including a stick storage and dispensing endless conveyor loop disposed within said cabinet.

6. The automated chemical stick loader according to claim 5, further including:

a plurality of immediately adjacent, laterally arrayed, J-shaped stick holder flights disposed about said conveyor loop; and a pneumatically actuated ratchet mechanism selectively advancing said conveyor in accordance with said control system.

7. The automated chemical stick loader according to claim 1, further including:

a first wellhead valve disposed in the well head;

a first wellhead valve actuator communicating with said first wellhead valve;

a second wellhead valve disposed in the wellhead above said first wellhead valve;

a second wellhead valve actuator communicating with said second wellhead valve;

a vent valve disposed between said first wellhead valve and said second wellhead valve; and a mechanical and pneumatic linkage sequentially communicating with said first wellhead valve, said second wellhead valve, and said vent valve.

8. The automated chemical stick loader according to claim 1, further including a stick kickover mechanism disposed at the top of the wellhead, the kickover mechanism communicating with said stick passage mechanism.

9. A gas well with an automated chemical stick loader, comprising:

a gas well;

a wellhead extending upwardly from said gas well;

a ground-based and ground-accessed stick storage and dispensing cabinet, said cabinet having a stick dispensing end;

a sequentially actuated stick dispensing mechanism disposed within said cabinet;

a sequentially actuated stick passage mechanism disposed atop said wellhead;

a stick transfer tube permanently affixed to and extending between said cabinet and said stick passage mechanism, said transfer tube having a cabinet attachment end and a wellhead attachment end opposite the cabinet attachment end;

a stick transfer mechanism disposed at the stick dispensing end of said cabinet and communicating with the cabinet attachment end of said transfer tube; and an automated stick dispensing control system disposed within said cabinet and communicating with said stick dispensing mechanism within said cabinet.

10. The gas well and automated chemical stick loader combination according to claim 9, wherein said control system comprises a programmable electronic controller.

11. The gas well and automated chemical stick loader combination according to claim 9, wherein said stick dispensing mechanism, said stick transfer mechanism, and said stick passage mechanism are each pneumatically actuated.

12. The gas well and automated chemical stick loader combination according to claim 11, further including a pneumatic pressure regulator disposed within said cabinet, communicating with said stick dispensing mechanism, said stick transfer mechanism, and said stick passage mechanism.

13. The gas well and automated chemical stick loader combination according to claim 9, further including a stick storage and dispensing endless conveyor loop disposed within said cabinet.

14. The gas well and automated chemical stick loader combination according to claim 13, further including:

a plurality of immediately adjacent, laterally arrayed, J-shaped stick holder flights disposed about said conveyor loop; and a pneumatically actuated ratchet mechanism selectively advancing said conveyor in accordance with said control system.

15. The gas well and automated chemical stick loader combination according to claim 9, further including:

a first wellhead valve disposed in said wellhead;

a first wellhead valve actuator communicating with said first wellhead valve;

a second wellhead valve disposed in said wellhead, above said first wellhead valve;

a second wellhead valve actuator communicating with said second wellhead valve;

a vent valve disposed in said wellhead, between said first wellhead valve and said second wellhead valve; and a mechanical and pneumatic linkage sequentially communicating with said first wellhead valve, said second wellhead valve, and said vent valve.

16. The gas well and automated chemical stick loader combination according to claim 9, further including a stick kickover mechanism disposed at the top of said wellhead, communicating with said stick passage mechanism.

17. A method of automatically dispensing and loading chemical sticks into a gas well, the well having an above-ground wellhead, comprising the steps of:

(a) loading a plurality of the sticks into flights of a conveyor belt at ground level;

(b) automatically and sequentially dispensing one of the sticks at a time from the conveyor belt into a transfer tube extending upward from the conveyor belt and fixed to a stick passage mechanism atop the wellhead at selected intervals;

(c) simultaneously with step (b), automatically advancing one of the sticks at a time from the transfer tube into the stick dispensing mechanism;

(d) simultaneously with steps (b) and (c), dispensing one of the sticks at a time from the stick passage mechanism into the wellhead.

18. The method of automatically dispensing and loading chemical sticks into a gas well according to the method of claim 17, further including the steps of:

(a) installing a first wellhead valve in the wellhead;

(b) installing a first wellhead valve actuator communicating with the first wellhead valve;

(c) installing a second wellhead valve in the wellhead, above the first wellhead valve;

(d) installing a second wellhead valve actuator communicating with the second wellhead valve;

(e) installing a vent valve disposed in said wellhead, between the first wellhead valve and the second wellhead valve;

(f) actuating the first wellhead valve actuator, thereby closing the first wellhead valve;

(g) opening the vent valve, thereby venting well gas trapped between the second wellhead valve and the first wellhead valve;

(h) actuating the second wellhead valve actuator, thereby opening the second wellhead valve;

(i) dropping a stick into the wellhead, past the open second wellhead valve and onto the closed first wellhead valve;

(j) actuating the second wellhead valve actuator, thereby closing the second wellhead valve; and (k) actuating the first wellhead valve actuator, thereby opening the first wellhead valve, with the stick falling into the well through the open first wellhead valve.

19. The method of automatically dispensing and loading chemical sticks into a gas well according to the method of claim 17, further including the steps of:

(a) providing a pneumatic pressure regulator disposed within the cabinet; and (b) regulating pneumatic actuating pressure to a pressure lower than internal well pressure for operating the stick dispensing mechanism, the stick transfer mechanism, and the stick passage mechanism.

* * * * *